US008855933B2

(12) United States Patent
Mitchell

(10) Patent No.: US 8,855,933 B2
(45) Date of Patent: Oct. 7, 2014

(54) SYSTEMS AND METHODS FOR DETERMINING THE MOMENTS AND FORCES OF TWO CONCENTRIC PIPES WITHIN A WELLBORE

(75) Inventor: Robert F. Mitchell, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 13/980,913

(22) PCT Filed: Jun. 24, 2011

(86) PCT No.: PCT/US2011/041867

§ 371 (c)(1),
(2), (4) Date: Sep. 30, 2013

(87) PCT Pub. No.: WO2012/177264

PCT Pub. Date: Dec. 27, 2012

(65) Prior Publication Data

US 2014/0032115 A1 Jan. 30, 2014

(51) Int. Cl.

| | |
|---|---|
| ***G01V 1/40*** | (2006.01) |
| ***E21B 47/00*** | (2012.01) |
| *E21B 47/09* | (2012.01) |

(52) U.S. Cl.

CPC ..... *E21B 47/00* (2013.01); *E21B 47/0006* (2013.01); *E21B 47/09* (2013.01)

USPC ..... 702/9; 702/43; 73/152.48; 73/152.49

(58) Field of Classification Search

CPC ..... E21B 47/0006; E21B 47/09; E21B 28/00; E21B 49/006

USPC ..... 73/152.49, 152.48

See application file for complete search history.

(56) References Cited

U.S. PATENT DOCUMENTS

| | | | | |
|---|---|---|---|---|
| 2,661,898 | A | | 12/1953 | Bubb |
| 2,698,133 | A | | 12/1954 | Bubb |
| 2,791,375 | A | | 5/1957 | Piety |
| 3,006,541 | A | | 10/1961 | Bubb |
| 4,382,381 | A | | 5/1983 | Soeiinah |
| 4,384,483 | A | * | 5/1983 | Dellinger et al. ..... 73/152.59 |
| 4,662,458 | A | * | 5/1987 | Ho ..... 175/27 |
| 4,848,144 | A | * | 7/1989 | Ho ..... 73/152.49 |
| 5,828,003 | A | * | 10/1998 | Thomeer et al. ..... 174/69 |

(Continued)

FOREIGN PATENT DOCUMENTS

| | | |
|---|---|---|
| GB | 0515327 | 12/1939 |
| WO | WO/2011/005262 A1 | 2/2011 |
| WO | 2011036144 | 3/2011 |

OTHER PUBLICATIONS

Blaine R. Copenheaver, The International Search Report and the Written Opinion of the international Searching Authority, PCT/US2011/41867, Nov. 18, 2011, 7 pages, ISA/US.

(Continued)

*Primary Examiner* — John Breene
*Assistant Examiner* — Timothy H Hwang
(74) *Attorney, Agent, or Firm* — Crain, Caton & James; Jennifer Trillsch

(57) ABSTRACT

Systems and methods for determining the bending moment and shear force of tubing and casing when the tubing buckles and contacts the casing.

44 Claims, 3 Drawing Sheets

(56) References Cited

U.S. PATENT DOCUMENTS

| | | | | |
|---|---|---|---|---|
| 6,286,595 | B1 | 9/2001 | Oxnevad et al. | |
| 6,321,596 | B1 | 11/2001 | Newman | |
| 6,684,952 | B2 | 2/2004 | Brockman et al. | |
| 7,388,190 | B2 | 6/2008 | Huang et al. | |
| 7,472,748 | B2 | 1/2009 | Gdanski et al. | |
| 7,636,671 | B2 | 12/2009 | Caveny et al. | |
| 7,661,480 | B2 | 2/2010 | Al-Anazi | |
| 7,664,654 | B2 | 2/2010 | Caveny et al. | |
| 8,214,188 | B2 * | 7/2012 | Bailey et al. | 703/10 |
| 2002/0166374 | A1 | 11/2002 | Demarchos et al. | |
| 2004/0103376 | A1 | 5/2004 | Pandey | |
| 2004/0206187 | A1 | 10/2004 | Williams | |
| 2004/0221985 | A1 | 11/2004 | Hill et al. | |
| 2006/0106588 | A1 * | 5/2006 | Mitchell | 703/10 |
| 2007/0067147 | A1 * | 3/2007 | Huang | 703/7 |
| 2008/0255817 | A1 | 10/2008 | Pabon et al. | |
| 2011/0024125 | A1 | 2/2011 | Wallace et al. | |

OTHER PUBLICATIONS

John Nguyen, International Preliminary Report on Patentability, PCT/US2011/041867, May 20, 2013, 6 pages, ISA/US.

Lubinski, A., et al.; Helical Buckling of Tubing Sealed in Packers; Journal of Petroleum Technology; Jun. 1962; pp. 655-670.

Mitchell, R.F.; Simple Frictional Analysis of Helical Buckling of Tubing; SPE Drilling Engineering, Dec. 1986, pp. 457-465; Trans., AIME, 281.

He, Xiaojun; An Integrated Three-Dimensional Wellstring Analysis Program; Paper No. 22316-MS DOI 10.2118/22316-MS Petroleum Computer Conference; Jun. 17, 1991; pp. 275-282; Dallas, Texas.

Mitchell, R.F.; Exact Analytic Solutions for Pipe Buckling in Vertical and Horizontal Wells; Paper No. 72079-PA DOI 10.2118/72079-PA Landmark Graphics SPE Journal vol. 7, No. 4; Dec. 2002; pp. 373-390.

Mitchell, R.F.; Buckling Analysis in Deviated Wells: A Practical Method; Paper No. 36761-MS DOI 10.2118/36761-MS Enertech Engineering and Research Co. SPE Annual Technical Conference and Exhibition; Oct. 6, 1996; pp. 871-883.

Cheatham, J.B. and Chen, Y.C.; New Design Considerations for Tubing and Casing Buckling in Inclined Wells; Paper No. 5826-MS Offshore Technology Conference, May 1, 1988; pp. 187-192; Houston, Texas.

Chen, Yy-Che, Lin, Yu-Hsu and Cheatham, John B.; Tubing and Casing Buckling in Horizontal Wells (with associated papers 21257 and 21308); Paper No. 19176-PA DOI 10.2118/19176-PA Journal of Petroleum Technology vol. 42, No. 2; Feb. 1990; pp. 140-141, 191, 1062-1063.

Bhalla, K. and Walton, I.C.; The Effect of Fluid Flow on Coiled-Tubing Reach; Paper No. 36464-PA DOI 10.2118/36464-PA Journal—SPE Production & Facilities vol. 13, No. 1, Feb. 1998 pp. 59-63.

Mitchell, R.F.; The Twist and Shear of Helically Buckled Pipe; Paper No. 87894-PA DOI 10.2118/87894-PA Journal SPE Drilling & Completion vol. 19, No. 1; Mar. 2004; pp. 20-28.

Chen. V.C., Lin, V.H. and Cheatham, J.B.; An Analysis of Tubing and Casing Buckling in Horizontal Wells; Paper No. 6037-MS DOI 10.4043/6037-MS Offshore Technology Conference; May 1, 1989; pp. 617-620.

Jackson, Ellizabeth M.; Platform-Well Tieback Procedures at Island Esther; Paper No. 16365-PA DOI 10.2118/16365-PA Journal SPE Drilling Engineering, vol. 5, No. 1; Mar. 1990; pp. 45-50.

Mitchell, R.F.; Buckling Behavior of Well Tubing: The Packer Effect; Paper No. 9264-PA DOI 10.2118/9264-PA SPE Journal vol. 22, No. 5; Oct. 1982, pp. 616-624.

Anderson, K.A.; Support Systems for High Wellhead Loads; Paper No. 84-03-11 Journal of Canadian Petroleum Technology, vol. 23, No. 3; May 1984; pp. 76-78.

Inoue, T.; Ozaki, M. and Wada, K.; Observations on Dynamic Tensions of Drill String During Drilling Operations of Scientific Drilling Vessel Chikyu; Oceans 2009, MTS/IEEE Biloxi—Marine Technology for Our Future: Global and Local Challenges; Oct. 26, 2009; pp. 1-5.

Dusseault, M.B., et al.; Casing Shear: Causes, Cases, Cures; SPE Drilling & Completion; 2001; pp. 98-107.

Christman, Stan A.; Casing Stresses Caused by Buckling of Concentric Pipes; SPE 6059, Society of Petroleum Engineers of AIME; Oct. 1976; 16 pgs.; Dallas, Texas.

Archer, Robert R., Cook, Nathan H., Crandall, Stephen H., Dahl, Norman C., Lardner, Thomas J., McClintock, Frank A., Rabinowicz, Ernest and Reichenbach, George S.; An Introduction to the Mechanics of Solids, Second Edition; First Edition Edited by Stephen H. Crandall and Norman C. Dahl; Second Edition Edited by Thomas J. Lardner; 1972; pp. 584-585; McGraw-Hill Book Company, New York.

Weber, Ron; Australian Patent Examination Report No. 1; Nov. 6, 2013; 3 pgs.; Australian Government-IP.

* cited by examiner

SYSTEMS AND METHODS FOR DETERMINING THE MOMENTS AND FORCES OF TWO CONCENTRIC PIPES WITHIN A WELLBORE

CROSS-REFERENCE TO RELATED APPLICATIONS

The priority of PCT Patent Application No. PCT/US2011/41867, filed on Jun. 24, 2011, is hereby claimed, and the specification thereof is incorporated herein by reference.

STATEMENT REGARDING FEDERALLY SPONSORED RESEARCH

Not applicable.

FIELD OF THE INVENTION

The present invention generally relates to systems and methods for determining the moments and forces of two concentric pipes within a wellbore. More particularly, the present invention relates to determining the bending moment and shear force of tubing and casing when the tubing buckles and contacts the casing.

BACKGROUND OF THE INVENTION

Oil wells typically have multiple concentric pipes called casing strings. In FIG. 1, the configuration 100 of two concentric pipes is illustrated. The internal pipe 102 is designated "tubing" and the external pipe 104 is designated "casing." There is a wellbore 106 that is considered rigid in this analysis.

For a set of two concentric strings, if the internal pipe has a compressive axial force, it will typically deform into a helically shaped configuration within the other string, as shown in FIG. 1. The cross-sectional areas of the various pipes are described by:

$$A_{ti}=\pi r_{ti}^2$$

$$A_{te}=\pi r_{te}^2$$

$$A_{ci}=\pi r_{ci}^2$$

$$A_{ce}=\pi r_{ce}^2 \quad (1)$$

where $r_{ti}$ is the inside radius of the tubing, $r_{te}$ is the outside radius of the tubing, $r_{ci}$ is the inside radius of the casing, and $r_{ce}$ is the outside radius of the casing. Clearances between the various pipes and the wellbore are given as:

$$r_c=r_{ci}-r_{te}$$

$$r_{oc}=r_w-r_{ce} \quad (2)$$

Where $r_c$ is the radial clearance between the tubing and casing, and $r_{oc}$ is the radial clearance between the casing and the wellbore and $r_w$ is the wellbore radius. Most analyses of this problem assume that the outer casing is rigid. In reality, this external casing is also elastic and would displace due to the loads generated by contact with the internal pipe. Further, if both strings have compressive axial forces, both strings will buckle, and the resulting buckled configuration must fit together so that contact forces between the two strings are positive and the pipes do not each occupy the same space. If the two strings have an external, cylindrical rigid wellbore, then any contact forces with this wellbore must also be positive and the buckled pipe system must lie within this wellbore.

This configuration is illustrated as a cross-section in FIG. 1 before buckling takes place. The post-buckling configuration 200 is illustrated in FIG. 2.

There is only one known solution to the problem presented by multiple concentric buckling pipes, which is described in SPE 6059 by Stan A. Christman entitled "*Casing Stresses Caused by Buckling of Concentric Pipes*." In this article, a composite pipe based on the summed properties of the individual pipes is proposed. Further, the pipes do not touch each other, but are assumed to remain concentric. The deficiency in this analysis is that it does not conform to the requirements that i) the contact forces between the two strings are positive and the pipes do not each occupy the same space; and ii) the contact forces with the wellbore are positive and the buckled pipe system lies within the wellbore. As a result the assumption that the pipes do not touch each other but remain concentric renders an inaccurate displacement solution.

SUMMARY OF THE INVENTION

The present invention therefore, overcomes one or more deficiencies in the prior art by providing systems and methods for determining the bending moment and shear force of tubing and casing when the tubing buckles and contacts the casing.

In one embodiment, the present invention includes a method for determining the moments and forces of two concentric pipes within a wellbore, comprising: i) determining an external pipe displacement using a computer processor; ii) determining whether the external pipe contacts the wellbore based on the external pipe displacement; iii) determining a bending moment and a shear force of an internal pipe and the external pipe based on contact between the internal pipe and the external pipe and the external pipe displacement if the external pipe does not contact the wellbore; iv) determining whether contact forces between the internal pipe and the external pipe and between the external pipe and the wellbore are greater than or equal to zero if the external pipe contacts the wellbore; v) determining the bending moment and the shear force of the internal pipe and the external pipe, using the computer processor, based on contact between the internal pipe and the external pipe and contact between the external pipe and the wellbore if the contact forces between the internal pipe and the external pipe and between the external pipe and the wellbore are greater than or equal to zero; vi) determining a displacement solution using a contact force between the internal pipe and the external pipe equal to zero if the contact forces between the internal pipe and the external pipe and between the external pipe and the wellbore are not greater than or equal to zero; vii) determining whether there is another displacement solution using a contact force between the external pipe and the wellbore equal to zero if the contact forces between the internal pipe and the external pipe and between the external pipe and wellbore are not greater than or equal to zero; and viii) determining the bending moment and the shear force of the internal pipe and the external pipe based on the displacement solution or the another displacement solution if the contact forces between the internal pipe and the external pipe and between the external pipe and the wellbore are not greater than or equal to zero.

In another embodiment, the present invention includes a non-transitory program carrier device tangibly carrying computer executable instructions for determining the moments and forces of two concentric pipes within a wellbore, the instructions being executable to implement: i) determining an external pipe displacement; ii) determining whether the external pipe contacts the wellbore based on the external pipe displacement; iii) determining a bending moment and a shear force of an internal pipe and the external pipe based on contact between the internal pipe and the external pipe and the external pipe displacement if the external pipe does not contact the wellbore; iv) determining whether contact forces between the internal pipe and the external pipe and between the external pipe and the wellbore are greater than or equal to zero if the external pipe contacts the wellbore; v) determining the bending moment and the shear force of the internal pipe and the external pipe based on contact between the internal pipe and the external pipe and contact between the external pipe and the wellbore if the contact forces between the internal pipe and the external pipe and between the external pipe and the wellbore are greater than or equal to zero; vi) determining a displacement solution using a contact force between the internal pipe and the external pipe equal to zero if the contact forces between the internal pipe and the external pipe and between the external pipe and the wellbore are not greater than or equal to zero; vii) determining whether there is another displacement solution using a contact force between the external pipe and the wellbore equal to zero if the contact forces between the internal pipe and the external pipe and between the external pipe and wellbore are not greater than or equal to zero; and viii) determining the bending moment and the shear force of the internal pipe and the external pipe based on the displacement solution or the another displacement solution if the contact forces between the internal pipe and the external pipe and between the external pipe and the wellbore are not greater than or equal to zero.

In yet another embodiment, the present invention includes a method for determining the moments and forces of two concentric pipes within a wellbore, comprising: i) determining an external pipe displacement using a computer processor; ii) determining whether the external pipe contacts the wellbore based on the external pipe displacement; and iii) determining a bending moment and a shear force of an internal pipe and the external pipe, using the computer processor, based on at least one of contact between the internal pipe and the external pipe and contact between the external pipe and the wellbore.

In yet another embodiment, the present invention includes a non-transitory program carrier device tangibly carrying computer executable instructions for determining the moments and forces of two concentric pipes within a wellbore, the instructions being executable to implement: i) determining an external pipe displacement; ii) determining whether the external pipe contacts the wellbore based on the external pipe displacement; and iii) determining a bending moment and a shear force of an internal pipe and the external pipe based on at least one of contact between the internal pipe and the external pipe and contact between the external pipe and the wellbore.

Additional aspects, advantages and embodiments of the invention will become apparent to those skilled in the art from the following description of the various embodiments and related drawings.

BRIEF DESCRIPTION OF THE DRAWINGS

The present invention is described below with references to the accompanying drawings in which like elements are referenced with like reference numerals, and in which.

DETAILED DESCRIPTION OF THE PREFERRED EMBODIMENTS

Figure 1:
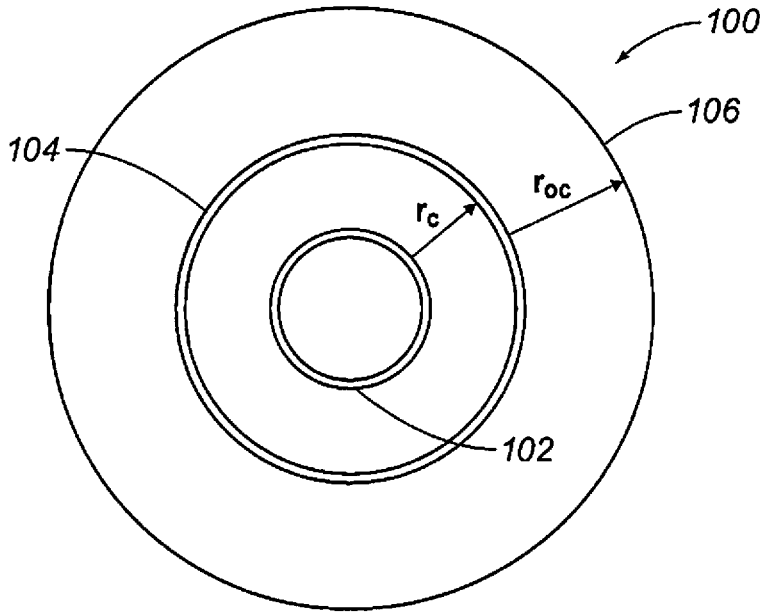
FIG. 1 is a cross sectional view illustrating two concentric pipes within a wellbore before buckling.

The subject matter of the present invention is described with specificity, however, the description itself is not intended to limit the scope of the invention. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present invention may be applied in the oil and gas industry, it is not limited thereto and may also be applied in other industries to achieve similar results. The nomenclature used herein is described in Table 1 below.

TABLE 1

| | |
|---|---|
| $A_{ci}$ = | casing inside area, ($in^2$) |
| $A_{ce}$ = | casing outside area, ($in^2$) |
| $A_{ti}$ = | tubing inside area, ($in^2$) |
| $A_{te}$ = | tubing outside area, ($in^2$) |
| E = | Young's modulus (psi) |
| $E_c$ = | Young's modulus of the casing (psi) |
| $E_t$ = | Young's modulus of the tubing (psi) |
| F = | axial tension in casing (lbf) |
| I = | moment of inertia ($in^4$) |
| $I_c$ = | moment of inertia of the casing ($in^4$) |
| $I_t$ = | moment of inertia of the tubing ($in^4$) |
| M = | bending moment, (in-lbf) |
| $M_c$ = | bending moment of the casing, (in-lbf) |
| $M_t$ = | bending moment of the tubing, (in-lbf) |
| P = | axial compression in tubing (lbf) |
| $p_1$ = | pressure inside tubing (psi) |
| $p_2$ = | pressure outside tubing and inside casing (psi) |
| $p_3$ = | pressure outside casing (psi) |
| $r_{ci}$ = | casing inside radius, (in) |
| $r_{ce}$ = | casing outside radius, (in) |
| $r_{ti}$ = | tubing inside radius, (in) |
| $r_{te}$ = | tubing outside radius, (in) |
| $r_c$ = | nominal radial clearance between the tubing and casing (in) |
| $r_{ic}$ = | $r_{oc} - t_c$, (in) |
| $r_{oc}$ = | nominal radial clearance between the casing and exterior wellbore (in) |
| $r_w$ = | the wellbore radius, (in) |
| s = | measured depth, (in) |
| $t_c$ = | the thickness of the casing (in) |
| $u_1$ = | tubing displacement in coordinate direction 1, (in) |
| $u_2$ = | tubing displacement in coordinate direction 2, (in) |
| $v_1$ = | casing displacement in coordinate direction 1, (in) |
| $v_2$ = | casing displacement in coordinate direction 2, (in) |
| V = | shear force (lbf) |
| $V_c$ = | shear force in the casing (lbf) |
| $V_t$ = | shear force in the tubing (lbf) |
| $w_c$ = | tubing contact force buckled in a rigid cylinder, (lbf/in) |
| $\hat{w}_c$ = | tubing contact force buckled in an elastic cylinder, (lbf/in) |
| $w_{tc}$ = | the contact force between the tubing and casing, (lbf/in) |
| $w_{wc}$ = | the contact force between the wellbore and the casing, (lbf/in) |
| $2\pi/\beta$ = | the pitch of a displacement function representing a helix |
| $\upsilon$ = | absolute radial displacement of the casing, (in) |
| $\tau$ = | shear stress, (psi) |
| $\sigma_r$ = | radial stress, (psi) |
| $\sigma_\theta$ = | hoop stress, (psi) |
| $\sigma_z$ = | axial stress, (psi) |

Method Description

Figure 2:
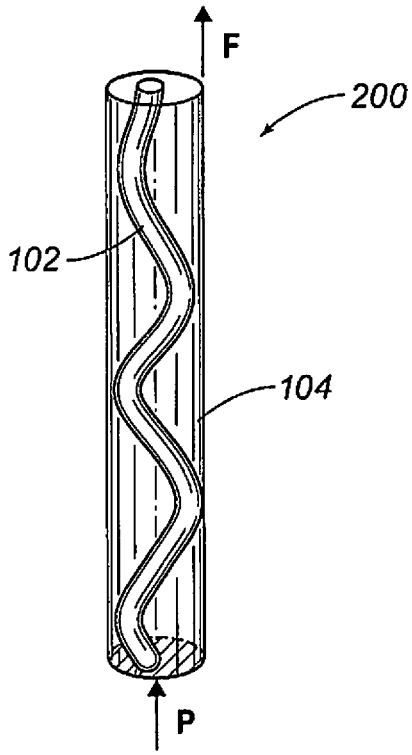
FIG. 2 is an elevational view of the two concentric pipes illustrated in FIG. 1 after buckling.

Referring now to FIG. 2, the general configuration 200 of the two concentric pipes in FIG. 1 is illustrated after buckling. For purposes of the following description, the tubing 102 is the internal pipe and the casing 104 is the external pipe although the internal pipe and the external pipe may be both tubing or both casing. The tubing 102 has buckled in a helical shape due to the applied compressive force P and contacts the casing 104. P and F are "compressive force" and "effective tension," respectively:

$$P=-F_t+p_1A_{ti}-p_2A_{te}$$

$$F=F_c+p_2A_{ci}-p_3A_{ce} \tag{3}$$

where $F_t$ is the tubing axial tension, $F_c$ is the casing axial tension, $p_1$ is the fluid pressure inside the tubing, $p_2$ is the pressure outside the tubing (inside the casing), and $p_3$ is the pressure outside the casing. The effect of pressure on the buckling behavior of pipe is well known in the art.

The buckled tubing has the form:

$$u_1 = r_c\sin(\beta s) \tag{4a}$$

$$u_2 = r_c\cos(\beta s) \tag{4b}$$

$$\beta = \sqrt{\frac{P}{2E_tI_t}} \tag{4c}$$

Where $u_1$ is the displacement in the 1 coordinate direction, $u_2$ is the displacement in the 2 coordinate direction, P is the axial compressive force on the tubing, $E_t$ is Young's modulus for the tubing, $I_t$ is the moment of inertia of the tubing$=\frac{1}{4}\pi(r_{te}^2-r_{ti}^2)$, and $r_c$ is the radial clearance between the internal tubing and the external casing given in equations (2). The displacement represented by equations (4a) and (4b) is a helix with a pitch equal to $2\pi/\beta$. Thus, $\beta$ represents a possible displacement solution in equation (4c).

The contact force between the tubing and casing is:

$$w_c = \frac{r_cP^2}{4E_tI_t} \tag{5}$$

The equilibrium equations of the outer casing with load applied by the internal tubing are:

$$E_cI_c\frac{d^4v_1}{ds^4} - F\frac{d^2v_1}{ds^2} - \hat{w}_c\sin(\beta s) = 0 \tag{6}$$

$$E_cI_c\frac{d^4v_2}{ds^4} - F\frac{d^2v_2}{ds^2} - \hat{w}_c\cos(\beta s) = 0$$

where $v_1$ is the displacement of the casing in the 1 coordinate direction, $v_2$ is the displacement of the casing in the 2 coordinate direction, F is the effective axial tensile force on the casing, $E_c$ is Young's modulus for the casing, $I_c$ is the moment of inertia of the casing$=\frac{1}{4}\pi(r_{ce}^2-r_{ci}^2)$, and $\hat{w}_c$ is the contact force on the casing by the tubing. The contact force will be different from equation (5) because the radial clearance may change because of displacements $v_1$ and $v_2$. The particular solution to equations (6) suitable for this analysis is:

$$v_1=\upsilon\sin(\beta s)$$

$$v_2=\upsilon\cos(\beta s) \tag{7}$$

The contact force becomes:

$$\hat{w}_c = \frac{(r_c+\upsilon)P^2}{4E_tI_t} \tag{8}$$

where the radial clearance is increased by the casing displacement $\upsilon$. Substituting equations (7) and equation (8) into equations (6), $\upsilon$ may be solved by:

$$\upsilon = \frac{r_cPE_tI_t}{2FE_tI_t + P(E_cI_c - E_tI_t)} \tag{9}$$

For simplicity, a rigid wellbore outside the casing is assumed. Thus, the radial clearance of the casing ($r_{oc}$) will put a limit on the magnitude of the casing displacement ($\upsilon$). When the casing displacement does not exceed the limit, meaning the buckled tubing contacts the casing but the casing does not contact the wellbore, the following results may be used to determine the bending moment and shear force of the casing and tubing.

The bending moment of the casing and tubing due to the buckled internal tubing is:

$$M_c = \frac{r_cP^2E_cI_c}{2P(E_cI_c - E_tI_t) + 4FE_tI_t} \tag{10a}$$

$$M_t = M_t = E_tI_t(r_c+\upsilon)\beta^2 \tag{10b}$$

And the shear force of the casing and tubing due to the buckled internal tubing is:

$$V_c = F - \frac{PE_cI_c}{E_tI_t} \tag{11a}$$

$$V_t = (r_c+\upsilon)\beta|E_tI_t\beta^2 - P| \tag{11b}$$

When the casing displacement exceeds the limit, meaning the casing contacts the wellbore, it is not immediately clear that $\beta$ will be given by equation (4c). If the principle of virtual work is applied to the sum of the casing and tubing bending energy and the work done by the casing and tubing axial loads (axial movement of each of the two strings are assumed independent of each other), then:

$$\beta^2 = \frac{Pr_{ic}^2 - Fr_{oc}^2}{EI_tr_{ic}^2 + EI_cr_{oc}^2} \tag{12}$$

where $r_{ic}=r_{oc}-t_c$, with $t_c$ equal to the thickness of the casing. Note that equation (12) is still valid for negative F, that is, both strings may be buckled. Equation (12) is not valid for $\beta^2<0$. There are two further conditions that $\beta$ must satisfy:

The contact force between the tubing and casing ($w_{tc}$) must be $\geq 0$ (13)

The contact force between the casing and wellbore ($w_{wc}$) must be $\geq 0$ (14)

The expectation is that since $\upsilon$ is greater than $r_{oc}$, then the displacement solution $\beta$ given by equation (4c) will satisfy condition (13), so a solution for $\beta$ exists, although it may not be given by equation (12). Equation (12), however, is preferred over equation (4c) for a possible displacement solution if it satisfies conditions (13) and (14). The contact forces are given by the following equilibrium equations:

$$r_{ic}[P\beta^2-E_tI_t\beta^4]=w_{tc} \tag{15a}$$

$$r_{oc}[E_cI_c\beta^4+F\beta^2]=-w_{wc}+w_{tc} \tag{15b}$$

where $w_{tc}$ is the contact force between the tubing and casing, and $w_{wc}$ is the contact force between the wellbore and the casing. Solving for $w_{wc}$:

$$w_{wc}=\beta^2(Pr_{ic}-Fr_{oc})-\beta^4(E_tI_tr_{ic}+E_cI_cr_{oc}) \tag{16}$$

The contact forces are required to satisfy conditions (13) and (14):

$$w_{tc}\geq 0$$

$$w_{wc}\geq 0 \tag{17}$$

If equation (12) satisfies conditions (13) and (14), then it is a valid displacement solution for 13. If conditions (13) and (14) are not satisfied, then 13 must lie in the range where conditions (13) and (14) are satisfied. The principle of virtual work used to determine equation (12) minimizes the potential energy of the system represented by the two concentric pipes (strings) in FIG. 2. When the optimal displacement solution lies outside of the possible range of β, then the displacement solution is the boundary value of β that minimizes the potential energy of the system. The boundaries on the possible values of β are determined by:

$$w_{tc}=0\Rightarrow\beta^2=\frac{P}{E_tI_t} \tag{18}$$

or $$w_{wc}=0\Rightarrow\beta^2=\frac{Pr_{ic}-Fr_{oc}}{E_tI_tr_{ic}+E_cI_cr_{oc}} \tag{19}$$

As before, equation (19) is not a valid displacement solution for β if $\beta^2<0$, but equation (18) is always a valid displacement solution for β from the initial assumptions. Thus, there is at least one displacement solution for β that is given by equation (18). The total potential energy of the system is:

$$U=\tfrac{1}{2}(E_cI_cr_{oc}^2+E_tI_tr_{ic}^2)\beta^4+\tfrac{1}{2}(Fr_{oc}^2-Pr_{oc}^2)\beta^2 \tag{20}$$

If equation (19) also provides another valid displacement solution for β, meaning $\beta^2\geq 0$, then there are two potential displacement solutions for β given by equations (18) and (19). Therefore, if both equations (18) and (19) satisfy conditions (13) and (14), then the displacement solution for β that minimizes equation (20) is preferred and selected for determining the bending moment and shear force of the tubing and casing.

Given the displacement solution from equations (12), (18) and/or (19) that is the only valid solution or that is the solution that will produce the least potential energy for the system, the bending moment and shear force of the tubing and casing may be determined by the following equations when the casing contacts the wellbore:

$$M_t=E_tI_tr_{ic}\beta^2 \tag{21a}$$

$$M_c=E_cI_cr_{oc}\beta^2 \tag{21b}$$

$$V_t=r_{ic}\beta|E_tI_t\beta^2-P| \tag{21c}$$

$$V_c=r_{oc}\beta|E_cI_c\beta^2+F| \tag{21d}$$

Figure 3:
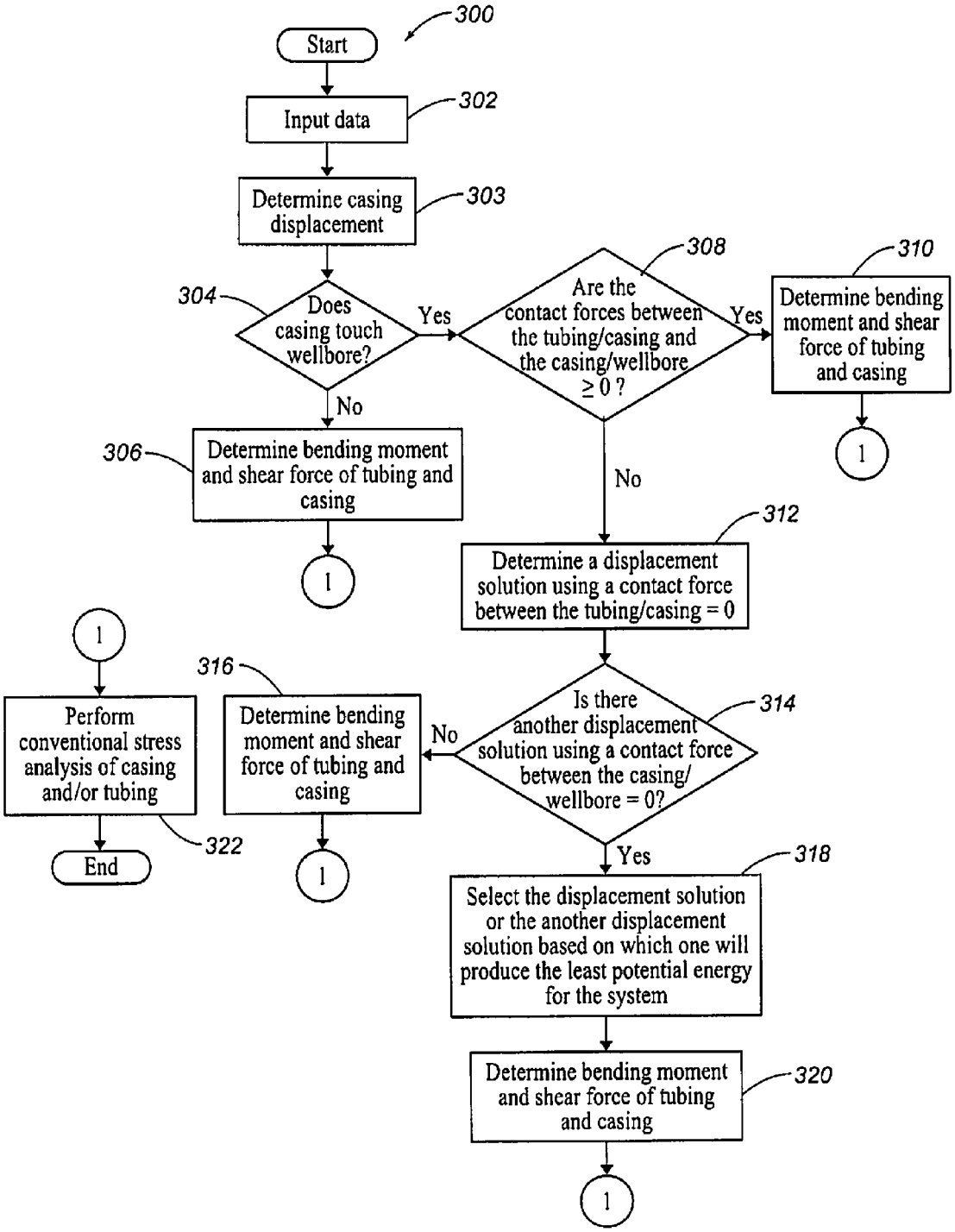
FIG. 3 is a flow diagram illustrating one embodiment of a method for implementing the present invention.

Referring now to FIG. 3, a flow diagram illustrates one of embodiment of a method 300 for implementing the present invention.

Figure 4:
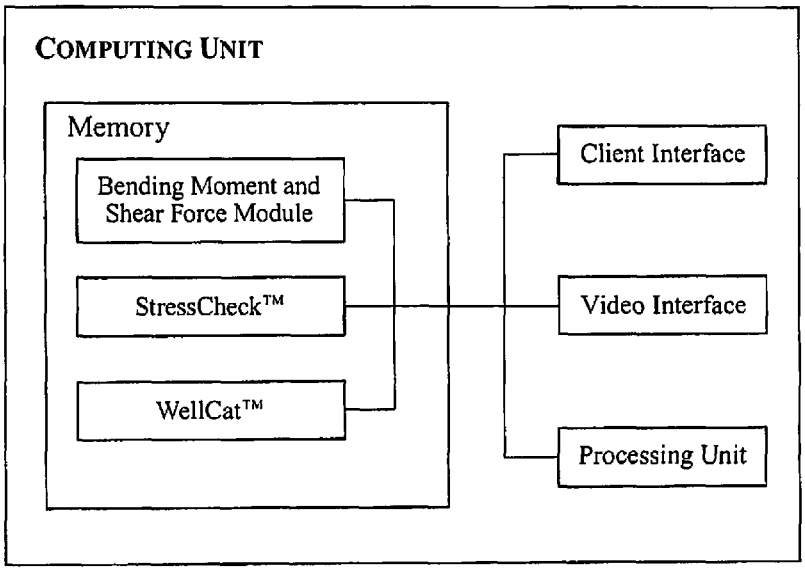
FIG. 4 is a block diagram illustrating one embodiment of a system for implementing the present invention.

In step 302, data is input using the client interface/video interface described in reference to FIG. 4. The data may include, for example, the inside and outside diameters of the tubing and the casing, the axial force in the tubing and casing, the wellbore diameter and the pressures inside and outside the tubing and casing.

In step 303, a casing displacement is determined. In one embodiment, a casing displacement may be determined by the result from equation (9). Other techniques well known in the art, however, may be used to determine a casing displacement.

In step 304, the method 300 determines if the casing touches the wellbore. In one embodiment, this may be determined by comparing the casing displacement result from equation (9) with the casing radial clearance ($r_{oc}$) that is known. If the casing touches the wellbore, then the method 300 proceeds to step 308. If the casing does not touch wellbore, then the method 300 proceeds to step 306. Other techniques well known in the art, however, may be used to determine if the casing touches the wellbore.

In step 306, the bending moment and shear force of the tubing and casing are determined. In one embodiment, the bending moment and shear force of the tubing and casing may be determined by using the result from equation (4c) and equations (10a) and (10b) to determine the bending moment of the casing and tubing, respectively, and by using the result from equation (4c) and equations (11a) and (11b) to determine the shear force of the casing and tubing, respectively. Other techniques well known in the art, however, may be used to determine the bending moment and shear force of the casing and tubing.

In step 308, the method 300 determines if the contact forces between the tubing/casing and the casing/wellbore are greater than or equal to zero. In one embodiment, this may be determined by using the result from equation (12) and equation (15a) to determine the contact force between the tubing and the casing and by using the result from equation (12) and equation (15b) to determine the contact force between the casing and the wellbore. If the contact forces between the tubing/casing and casing/wellbore are not greater than or equal to zero, then the method 300 proceeds to step 312. If the contact forces between the tubing/casing and the casing/wellbore are greater than or equal to zero, then method 300 proceeds to step 310. Other techniques well known in the art, however, may be used to determine the contact force between the tubing and the casing and the contact force between the casing and the wellbore.

In step 310, the bending moment and shear force of the tubing and casing are determined. In one embodiment, the bending moment and shear force of the tubing and casing may be determined by using the result from equation (12) and equations (21a), (21b) to determine the bending moment of the tubing and casing, respectively, and by using the result form equation (12) and equations (21c), (21d) to determine the shear force of the tubing and casing, respectively. Other techniques well known in the art, however, may be used to determine the bending moment and shear force of the casing and tubing.

In step 312, a displacement solution is determined using a contact force between the tubing/casing equal to zero. In one embodiment, a displacement solution may be determined by the result from equation (18) using a contact force between the tubing/casing equal to zero. Other techniques well known in the art, however, may be used to determine a displacement solution when the contact force between the tubing and the casing equals zero.

In step 314, the method 300 determines if there is another displacement solution using a contact force between the casing/wellbore equal to zero. In one embodiment, another displacement solution may be determined by the result from equation (19) using a contact force between the casing/wellbore equal to zero. If there is another displacement solution using a contact force between the casing/wellbore equal to zero, then the method 300 proceeds to 318. If there is not another displacement solution using a contact force between the casing/wellbore equal to zero, then the method 300 proceeds to step 316. Other techniques well known in the art, however, may be used to determine if there is another displacement solution when the contact force between the casing and the wellbore equals zero.

In step 316, the bending moment and shear force of the tubing and casing are determined. In one embodiment, the bending moment and shear force of the tubing and casing may be determined by using the result from equation (18) and equations (21a), (21b) to determine the bending moment of the tubing and casing, respectively, and by using the result from equation (18) and equations (21c), (21d) to determine the shear force of the tubing and the casing, respectively. Other techniques well known in the art, however, may be used to determine the bending moment and shear force of the casing and tubing.

In step 318, the displacement solution from step 312 or the another displacement solution from step 314 is selected based on which one will produce the least potential energy for the system. In one embodiment, the displacement solution and the another displacement solution may be used to determine the total potential energy of the system in equation (20). The result producing the least potential energy for the system is selected. Other techniques well known in the art, however, may be used to select the displacement solution or the another displacement solution for the system.

In step 320, the bending moment and shear force of the tubing and casing are determined. In one embodiment, the bending moment and shear force of the tubing and casing may be determined by using the displacement solution or the another displacement solution selected in step 318 and equations (21a), (21b) to determine the bending moment of the tubing and casing, respectively, and by using the displacement solution or the another displacement solution selected in step 318 and equations (21c), (21d) to determine the shear force of the tubing and casing, respectively. Other techniques well known in the art, however, may be used to determine the bending moment and shear force of the casing and tubing.

In step 322, a conventional stress analysis of the casing and/or tubing may be performed using techniques and/or applications well known in the art.

System Description

The present invention may be implemented through a computer-executable program of instructions, such as program modules, generally referred to as software applications or application programs executed by a computer. The software may include, for example, routines, programs, objects, components, and data structures that perform particular tasks or implement particular abstract data types. The software forms an interface to allow a computer to react according to a source of input. WellCat™ and StressCheck™, which are commercial software applications marketed by Landmark Graphics Corporation, may be used to implement the present invention. The software may also cooperate with other code segments to initiate a variety of tasks in response to data received in conjunction with the source of the received data. The software may be stored and/or carried on any variety of memory media such as CD-ROM, magnetic disk, bubble memory and semiconductor memory (e.g., various types of RAM or ROM). Furthermore, the software and its results may be transmitted over a variety of carrier media such as optical fiber, metallic wire and/or through any of a variety of networks such as the Internet.

Moreover, those skilled in the art will appreciate that the invention may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present invention. The invention may be practiced in distributed-computing environments where tasks are performed by remote-processing devices that are linked through a communications network. In a distributed-computing environment, program modules may be located in both local and remote computer-storage media including memory storage devices. The present invention may therefore, be implemented in connection with various hardware, software or a combination thereof, in a computer system or other processing system.

Referring now to FIG. 4, a block diagram illustrates one embodiment of a system for implementing the present invention on a computer. The system includes a computing unit, sometimes referred to a computing system, which contains memory, application programs, a client interface, a video interface and a processing unit. The computing unit is only one example of a suitable computing environment and is not intended to suggest any limitation as to the scope of use or functionality of the invention.

The memory primarily stores the application programs, which may also be described as program modules containing computer-executable instructions, executed by the computing unit for implementing the present invention described herein and illustrated in FIG. 3. The memory therefore, includes a bending moment and shear force module, which enables the methods illustrated and described in reference to FIG. 3 and integrates functionality from the remaining application programs in FIG. 4. The bending moment and shear force module, for example, may be used to execute many of the functions described in reference to steps 302-320 in FIG. 3. WellCat™ and StressCheck™ may be used, for example, to execute the functions described in reference to step 322 in FIG. 3.

Although the computing unit is shown as having a generalized memory, the computing unit typically includes a variety of computer readable media. By way of example, and not limitation, computer readable media may comprise computer storage media. The computing system memory may include computer storage media in the form of volatile and/or non-volatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to and/or presently being operated on by the processing unit. By way of example, and not limitation, the computing unit includes an operating system, application programs, other program modules, and program data.

The components shown in the memory may also be included in other removable/non-removable, volatile/nonvolatile computer storage media or they may be implemented in the computing unit through application program interface ("API"), which may reside on a separate computing unit connected through a computer system or network. For example only, a hard disk drive may read from or write to non-removable, nonvolatile magnetic media, a magnetic disk drive may read from or write to a removable, non-volatile magnetic disk, and an optical disk drive may read from or write to a removable, nonvolatile optical disk such as a CD ROM or other optical media. Other removable/non-removable, volatile/non-volatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

While the present invention has been described in connection with presently preferred embodiments, it will be understood by those skilled in the art that it is not intended to limit the invention to those embodiments. It is therefore, contemplated that various alternative embodiments and modifications may be made to the disclosed embodiments without departing from the spirit and scope of the invention defined by the appended claims and equivalents thereof.

The invention claimed is:

1. A method for determining the moments and forces of two concentric pipes within a wellbore, comprising:

determining an external pipe displacement using a computer processor;

determining whether the external pipe contacts the wellbore based on the external pipe displacement;

determining a bending moment and a shear force of an internal pipe and the external pipe based on contact between the internal pipe and the external pipe and the external pipe displacement if the external pipe does not contact the wellbore;

determining whether contact forces between the internal pipe and the external pipe and between the external pipe and the wellbore are greater than or equal to zero if the external pipe contacts the wellbore;

determining the bending moment and the shear force of the internal pipe and the external pipe, using the computer processor, based on contact between the internal pipe and the external pipe and contact between the external pipe and the wellbore if the contact forces between the internal pipe and the external pipe and between the external pipe and the wellbore are greater than or equal to zero;

determining a displacement solution using a contact force between the internal pipe and the external pipe equal to zero if the contact forces between the internal pipe and the external pipe and between the external pipe and the wellbore are not greater than or equal to zero;

determining whether there is another displacement solution using a contact force between the external pipe and the wellbore equal to zero if the contact forces between the internal pipe and the external pipe and between the external pipe and wellbore are not greater than or equal to zero; and determining the bending moment and the shear force of the internal pipe and the external pipe based on the displacement solution or the another displacement solution if the contact forces between the internal pipe and the external pipe and between the external pipe and the wellbore are not greater than or equal to zero.

2. The method of claim 1, further comprising selecting the displacement solution to determine the bending moment and the shear force of the internal pipe and the external pipe if there is not another displacement solution.

3. The method of claim 1, further comprising selecting the displacement solution to determine the bending moment and the shear force of the internal pipe and the external pipe if the displacement solution produces a total potential energy for a system represented by the internal pipe and the external pipe that is less than a total potential energy for the system produced by the another displacement solution.

4. The method of claim 1, further comprising selecting the another displacement solution to determine the bending moment and the shear force of the internal pipe and the external pipe if the another displacement solution produces a total potential energy for a system represented by the internal pipe and the external pipe that is less than a total potential energy for the system produced by the displacement solution.

5. The method of claim 1, further comprising performing a stress analysis of the internal pipe and the external pipe based on the bending moment and the shear force of the internal pipe and the external pipe.

6. The method of claim 1, wherein $$\upsilon = \frac{r_c P E_t I_t}{2FE_t I_t + P(E_c I_c - E_t I_t)}$$

is used to determine the casing displacement; $r_c$ is nominal radial clearance between the tubing and casing; P is axial compression in tubing; $E_t$ is Young's modulus of the tubing; $I_t$ is moment of inertia of the tubing; F is axial tension in casing; $E_c$ is Young's modulus of the casing and $I_c$ is moment of inertia of the casing.

7. The method of claim 1, wherein $$M_t = M_t = E_t I_t (r_c + \upsilon)\beta^2$$

$$M_c = \frac{r_c P^2 E_c I_c}{2P(E_c I_c - E_t I_t) + 4FE_t I_t}$$

$$V_t = (r_c + \upsilon)\beta|E_t I_t \beta^2 - P|$$

$$V_c = F - \frac{PE_c I_c}{E_t I_t}$$

are used to determine the bending moment and the shear force of the internal pipe and the external pipe if the external pipe does not contact the wellbore; $M_t$ is bending moment of the tubing; $E_t$ is Young's modulus of the tubing; $I_t$ is moment of inertia of the tubing; $r_c$ is nominal radial clearance between the tubing and casing; (υ) is casing displacement; β is a possible displacement solution; $M_c$ is bending moment of the casing; $E_c$ is Young's modulus of the casing; $I_c$ is moment of inertia of the casing; F is axial tension in casing; $V_t$ is shear force in the tubing; P is axial compression in tubing; and $V_c$ is shear force in the casing.

8. The method of claim 1, wherein $$\beta^2 = \frac{Pr_{ic}^2 - Fr_{oc}^2}{EI_t r_{ic}^2 + EI_c r_{oc}^2}$$

$$r_{ic}[P\beta^2 - E_t I_t \beta^4] = w_{tc}$$

$$r_{oc}[E_c I_c \beta^4 + F\beta^2] = -w_{wc} + w_{tc}$$

are used to determine the contact forces between the internal pipe and the external pipe and between the external pipe and the wellbore; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; E is Young's modulus; $I_t$ is moment of inertia of the tubing; $I_c$ is moment of inertia of the casing; $E_t$ is Young's modulus of the tubing; $w_{tc}$ is the contact force between the tubing and casing; $E_c$ is Young's modulus of the casing; β is a possible displacement solution; and $w_{wc}$ is the contact force between the wellbore and the casing.

9. The method of claim 1, wherein $$\beta^2 = \frac{Pr_{ic}^2 - Fr_{oc}^2}{EI_t r_{ic}^2 + EI_c r_{oc}^2}$$

is used to determine the bending moment and the shear force of the internal pipe and the external pipe if the contact forces between the internal pipe and the external pipe and between the external pipe and the wellbore are greater than or equal to zero; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; E is Young's modulus; $I_t$ is moment of inertia of the tubing; and $I_c$ is moment of inertia of the casing.

10. The method of claim 1, wherein $$w_{tc} = 0 \Rightarrow \beta^2 = \frac{P}{E_t I_t}$$

is used to determine the displacement solution; $w_{tc}$ is the contact force between the tubing and casing; P is axial compression in tubing; $E_t$ is Young's modulus of the tubing; and $I_t$ is moment of inertia of the tubing.

11. The method of claim 10, wherein $$w_{wc} = 0 \Rightarrow \beta^2 = \frac{Pr_{ic} - Fr_{oc}}{E_t I_t r_{ic} + E_c I_c r_{oc}}$$

is used to determine the another displacement solution; $w_{wc}$ is the contact force between the wellbore and the casing; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; $E_t$ is Young's modulus of the tubing; $I_t$ is moment of inertia of the tubing; $E_c$ is Young's modulus of the casing; and $I_c$ is moment of inertia of the casing.

12. The method of claim 11, wherein $$w_{tc} = 0 \Rightarrow \beta^2 = \frac{P}{E_t I_t}$$

or $$w_{wc} = 0 \Rightarrow \beta^2 = \frac{Pr_{ic} - Fr_{oc}}{E_t I_t r_{ic} + E_c I_c r_{oc}}$$

is used to determine the bending moment and the shear force of the internal pipe and the external pipe if the contact forces between the internal pipe and the external pipe and between the external pipe and the wellbore are not greater than or equal to zero; $w_{tc}$ is the contact force between the tubing and casing; $w_{wc}$ is the contact force between the wellbore and the casing; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; $E_t$ is Young's modulus of the tubing; $I_t$ is moment of inertia of the tubing; $E_c$ is Young's modulus of the casing; and $I_c$ is moment of inertia of the casing.

13. The method of claim 3, wherein $$U = \tfrac{1}{2}(E_c I_c r_{oc}^2 + E_t I_t r_{ic}^2)\beta^4 + \tfrac{1}{2}(Fr_{oc}^2 - Pr_{oc}^2)\beta^2$$

is used to determine the total potential energy for the system; $E_c$ is Young's modulus of the casing; $I_c$ is moment of inertia of the casing, $r_{oc}$ is nominal radial clearance between the casing and exterior wellbore; $E_t$ is Young's modulus of the tubing: $I_t$ is moment of inertia of the tubing; $r_{ic}$ is $r_{oc}-t_c$; $t_c$ is the thickness of the casing; β is a possible displacement solution; F is axial tension in casing; and P is axial compression in tubing.

14. A non-transitory program carrier device tangibly carrying computer executable instructions for determining the moments and forces of two concentric pipes within a wellbore, the instructions being executable to implement:

determining an external pipe displacement;

determining whether the external pipe contacts the wellbore based on the external pipe displacement;

determining a bending moment and a shear force of an internal pipe and the external pipe based on contact between the internal pipe and the external pipe and the external pipe displacement if the external pipe does not contact the wellbore;

determining whether contact forces between the internal pipe and the external pipe and between the external pipe and the wellbore are greater than or equal to zero if the external pipe contacts the wellbore;

determining the bending moment and the shear force of the internal pipe and the external pipe based on contact between the internal pipe and the external pipe and contact between the external pipe and the wellbore if the contact forces between the internal pipe and the external pipe and between the external pipe and the wellbore are greater than or equal to zero;

determining a displacement solution using a contact force between the internal pipe and the external pipe equal to zero if the contact forces between the internal pipe and the external pipe and between the external pipe and the wellbore are not greater than or equal to zero;

determining whether there is another displacement solution using a contact force between the external pipe and the wellbore equal to zero if the contact forces between the internal pipe and the external pipe and between the external pipe and wellbore are not greater than or equal to zero; and determining the bending moment and the shear force of the internal pipe and the external pipe based on the displacement solution or the another displacement solution if the contact forces between the internal pipe and the external pipe and between the external pipe and the wellbore are not greater than or equal to zero.

15. The program carrier device of claim 14, further comprising selecting the displacement solution to determine the bending moment and the shear force of the internal pipe and the external pipe if there is not another displacement solution.

16. The program carrier device of claim 14, further comprising selecting the displacement solution to determine the bending moment and the shear force of the internal pipe and the external pipe if the displacement solution produces a total potential energy for a system represented by the internal pipe and the external pipe that is less than a total potential energy for the system produced by the another displacement solution.

17. The program carrier device of claim 14, further comprising selecting the another displacement solution to determine the bending moment and the shear force of the internal pipe and the external pipe if the another displacement solution produces a total potential energy for a system represented by the internal pipe and the external pipe that is less than a total potential energy for the system produced by the displacement solution.

18. The program carrier device of claim 14, further comprising performing a stress analysis of the internal pipe and the external pipe based on the bending moment and the shear force of the internal pipe and the external pipe.

19. The program carrier device of claim 14, wherein $$\upsilon = \frac{r_c P E_t I_t}{2FE_t I_t + P(E_c I_c - E_t I_t)}$$

is used to determine the casing displacement; $r_c$ is nominal radial clearance between the tubing and casing; P is axial compression in tubing; $E_t$ is Young's modulus of the tubing; $I_t$ is moment of inertia of the tubing; F is axial tension in casing; $E_c$ is Young's modulus of the casing and $I_c$ is moment of inertia of the casing.

20. The program carrier device of claim 14, wherein $$M_t = M_t = E_t I_t (r_c + \upsilon)\beta^2$$

$$M_c = \frac{r_c P^2 E_c I_c}{2P(E_c I_c - E_t I_t) + 4FE_t I_t}$$

$$V_t = (r_c + \upsilon)\beta|E_t I_t \beta^2 - P|$$

$$V_c = F - \frac{PE_c I_c}{E_t I_t}$$

are used to determine the bending moment and the shear force of the internal pipe and the external pipe if the external pipe does not contact the wellbore; $M_t$ is bending moment of the tubing; $E_t$ is Young's modulus of the tubing; $I_t$ is moment of inertia of the tubing; $r_c$ is nominal radial clearance between the tubing and casing; (υ) is casing displacement; β is a possible displacement solution; $M_c$ is bending moment of the casing; $F_c$ is Young's modulus of the casing; $I_c$ is moment of inertia of the casing; F is axial tension in casing; $V_t$ is shear force in the tubing; P is axial compression in tubing; and $V_c$ is shear force in the casing.

21. The program carrier device of claim 14, wherein $$\beta^2 = \frac{Pr_{ic}^2 - Fr_{oc}^2}{EI_t r_{ic}^2 + EI_c r_{oc}^2}$$

$$r_{ic}[P\beta^2 - E_t I_t \beta^4] = w_{tc}$$

$$r_{oc}[E_c I_c \beta^4 + F\beta^2] = -w_{wc} + w_{tc}$$

are used to determine the contact forces between the internal pipe and the external pipe and between the external pipe and the wellbore; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; E is Young's modulus; $I_t$ is moment of inertia of the tubing; $I_c$ is moment of inertia of the casing; $E_t$ is Young's modulus of the tubing; $w_{tc}$ is the contact force between the tubing and casing; $E_c$ is Young's modulus of the casing; β is a possible displacement solution; and $w_{wc}$ is the contact force between the wellbore and the casing.

22. The program carrier device of claim 14, wherein $$\beta^2 = \frac{Pr_{ic}^2 - Fr_{oc}^2}{EI_t r_{ic}^2 + EI_c r_{oc}^2}$$

is used to determine the bending moment and the shear force of the internal pipe and the external pipe if the contact forces between the internal pipe and the external pipe and between the external pipe and the wellbore are greater than or equal to zero; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; E is Young's modulus; $I_t$ is moment of inertia of the tubing; and $I_c$ is moment of inertia of the casing.

23. The program carrier device of claim 14, wherein $$w_{tc} = 0 \Rightarrow \beta^2 = \frac{P}{E_t I_t}$$

is used to determine the displacement solution; $w_{tc}$ is the contact force between the tubing and casing; P is axial compression in tubing; $E_t$ is Young's modulus of the tubing; and $I_t$ is moment of inertia of the tubing.

24. The program carrier device of claim 19, wherein $$w_{wc} = 0 \Rightarrow \beta^2 = \frac{Pr_{ic} - Fr_{oc}}{E_t I_t r_{ic} + E_c I_c r_{oc}}$$

is used to determine the another displacement solution; $w_{wc}$ is the contact force between the wellbore and the casing; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; $E_t$ is Young's modulus of the tubing; $I_t$ is moment of inertia of the tubing; $E_c$ is Young's modulus of the casing; and $I_c$ is moment of inertia of the casing.

25. The program carrier device of claim 20, wherein $$w_{tc} = 0 \Rightarrow \beta^2 = \frac{P}{E_t I_t}$$

or $$w_{wc} = 0 \Rightarrow \beta^2 = \frac{Pr_{ic} - Fr_{oc}}{E_t I_t r_{ic} + E_c I_c r_{oc}}$$

is used to determine the bending moment and the shear force of the internal pipe and the external pipe if the contact forces between the internal pipe and the external pipe and between the external pipe and the wellbore are not greater than or equal to zero; $w_{tc}$ is the contact three between the tubing and casing; $w_{wc}$ is the contact force between the wellbore and the casing; P is axial compression in tubing; $r_{ic}$ is $r_{oc}-t_c$; $r_{oc}$ is nominal radial clearance between the casing and exterior wellbore; $t_c$ is the thickness of the casing; F is axial tension in casing; $E_t$ is Young's modulus of the tubing; $I_t$ is moment of inertia of the tubing; $E_c$ is Young's modulus of the casing; and $I_c$ is moment of inertia of the casing.

26. The program carrier device of claim 16, wherein $$U=\tfrac{1}{2}(E_c I_c r_{oc}^2+E_t I_t r_{ic}^2)\beta^4+\tfrac{1}{2}(Fr_{oc}^2-Pr_{oc}^2)\beta^2$$

is used to determine the total potential energy for the system; $E_c$ is Young's modulus of the casing; $I_c$ is moment of inertia of the casing, $r_{oc}$ is nominal radial clearance between the casing and exterior wellbore; $E_t$ is Young's modulus of the tubing; $I_t$ is moment of inertia of the tubing; $r_{ic}$ is $r_{oc}-t_c$; $t_c$ is the thickness of the casing; β is a possible displacement solution; F is axial tension in casing; and P is axial compression in tubing.

27. A method for determining the moments and forces of two concentric pipes within a wellbore, comprising:

determining an external pipe displacement using a computer processor;

determining whether the external pipe contacts the wellbore based on the external pipe displacement; and determining a bending moment and a shear force of an internal pipe and the external pipe, using the computer processor, based on at least one of contact between the internal pipe and the external pipe and contact between the external pipe and the wellbore.

28. The method of claim 27, wherein determining the bending moment and the shear force of the internal pipe and the external pipe is based on contact between the internal pipe and the external pipe and the external pipe displacement if the external pipe does not contact the wellbore.

29. The method of claim 27, wherein determining the bending moment and the shear force of the internal pipe and the external pipe is based on contact between the internal pipe and the external pipe and contact between the external pipe and the wellbore if the contact forces between the internal pipe and the external pipe and between the external pipe and the wellbore are greater than or equal to zero.

30. The method claim 27, wherein determining the bending moment and the shear force of the internal pipe and the external pipe is based on a displacement solution or another displacement solution if the contact forces between the internal pipe and the external pipe and between the external pipe and the wellbore are not greater than or equal to zero.

31. The method of claim 30, wherein the displacement solution is determined using a contact force between the internal pipe and the external pipe equal to zero.

32. The method of claim 30, wherein the another displacement solution is determined using a contact force between the external pipe and wellbore equal to zero.

33. The method of claim 30, wherein the displacement solution is used to determine the bending moment and the shear force of the internal pipe and the external pipe if there is not another displacement solution.

34. The method of claim 30, further comprising selecting the displacement solution to determine the bending moment and the shear force of the internal pipe and the external pipe if the displacement solution produces a total potential energy for a system represented by the internal pipe and the external pipe that is less than a total potential energy for the system produced by the another displacement solution.

35. The method of claim 30, further comprising selecting the another displacement solution to determine the bending moment and the shear force of the internal pipe and the external pipe if the another displacement solution produces a total potential energy for a system represented by the internal pipe and the external pipe that is less than a total potential energy for the system produced by the displacement solution.

36. A non-transitory program carrier device tangibly carrying computer executable instructions for determining the moments and forces of two concentric pipes within a wellbore, the instructions being executable to implement:

determining an external pipe displacement;

determining whether the external pipe contacts the wellbore based on the external pipe displacement; and determining a bending moment and a shear force of an internal pipe and the external pipe based on at least one of contact between the internal pipe and the external pipe and contact between the external pipe and the wellbore.

37. The program carrier device of claim 36, wherein determining the bending moment and the shear force of the internal pipe and the external pipe is based on contact between the internal pipe and the external pipe and the external pipe displacement if the external pipe does not contact the wellbore.

38. The program carrier device of claim 36, wherein determining the bending moment and the shear force of the internal pipe and the external pipe is based on contact between the internal pipe and the external pipe and contact between the external pipe and the wellbore if the contact forces between the internal pipe and the external pipe and between the external pipe and the wellbore are greater than or equal to zero.

39. The program carrier device claim 36, wherein determining the bending moment and the shear force of the internal pipe and the external pipe is based on a displacement solution or another displacement solution if the contact forces between the internal pipe and the external pipe and between the external pipe and the wellbore are not greater than or equal to zero.

40. The program carrier device of claim 39, wherein the displacement solution is determined using a contact force between the internal pipe and the external pipe equal to zero.

41. The program carrier device of claim 39, wherein the another displacement solution is determined using a contact force between the external pipe and wellbore equal to zero.

42. The program carrier device of claim 39, wherein the displacement solution is used to determine the bending moment and the shear force of the internal pipe and the external pipe if there is not another displacement solution.

43. The program carrier device of claim 39, further comprising selecting the displacement solution to determine the bending moment and the shear force of the internal pipe and the external pipe if the displacement solution produces a total potential energy for a system represented by the internal pipe and the external pipe that is less than a total potential energy for the system produced by the another displacement solution.

44. The program carrier device of claim 39, further comprising selecting the another displacement solution to determine the bending moment and the shear force of the internal pipe and the external pipe if the another displacement solution produces a total potential energy for a system represented by the internal pipe and the external pipe that is less than a total potential energy for the system produced by the displacement solution.

* * * * *